United States Patent [19]

Nye

[11] Patent Number: 4,781,375

[45] Date of Patent: Nov. 1, 1988

[54] METHOD AND APPARATUS FOR ADJUSTING A BASKETBALL GOAL

[75] Inventor: Stephen F. Nye, Roy, Utah

[73] Assignee: Lifetime Products, Inc., Clearfield, Utah

[21] Appl. No.: 922,041

[22] Filed: Oct. 21, 1986

[51] Int. Cl.[4] ..... A63B 63/08

[52] U.S. Cl. ..... 273/15 R; 248/354.6; 248/333; 248/648; 248/653

[58] Field of Search ..... 273/1.5 R, 1.5 A; 248/407-409, 354.6, 640-643, 648, 653, 354.7, 284, 333-338; 297/346; 108/145; 182/141

[56] References Cited

U.S. PATENT DOCUMENTS

| | | | |
|---|---|---|---|
| 214,549 | 4/1879 | Bruen | 248/336 |
| 214,618 | 4/1879 | Bruen | 248/336 |
| 334,243 | 1/1886 | Lang et al. | 248/335 |
| 627,516 | 6/1899 | Morgan . | |
| 964,394 | 7/1910 | Coddington | 248/407 X |
| 1,189,044 | 6/1916 | Boden | 248/333 |
| 2,313,188 | 3/1943 | Woodburn | 273/1.5 |
| 3,017,183 | 1/1962 | Chalcroft | 273/1.5 |
| 3,376,068 | 4/1968 | Walkinshaw | 297/437 |
| 3,427,025 | 2/1969 | Procter | 273/1.5 |
| 3,469,870 | 9/1969 | Barkus | 287/58 |
| 3,544,110 | 12/1970 | Dickinson | 273/1.5 R |
| 3,586,324 | 6/1971 | Bearson | 273/1.5 |
| 3,765,676 | 10/1973 | Bearson | 273/1.5 R |
| 3,802,702 | 4/1974 | Pulley | 273/1.5 R |
| 4,145,044 | 3/1979 | Wilson et al. | 273/1.5 R |
| 4,330,101 | 5/1982 | Andersen | 248/284 |
| 4,395,040 | 7/1983 | White | 273/1.5 R |
| 4,412,679 | 11/1983 | Mahoney et al. | 273/1.5 R |
| 4,465,277 | 8/1984 | Dittrich | 273/1.5 |
| 4,684,129 | 8/1987 | Andersen et al. | 273/1.5 R |

FOREIGN PATENT DOCUMENTS

| | | | |
|---|---|---|---|
| 876190 | 5/1953 | Fed. Rep. of Germany | 248/354.6 |

OTHER PUBLICATIONS

Catalog of Diversified Products, "25 Years of Innovation" (date of publication not known), pp. 61-72.
Sketches.
Instruction Sheet (date unknown).

*Primary Examiner*—Paul E. Shapiro
*Attorney, Agent, or Firm*—Workman, Nydegger & Jensen

[57] ABSTRACT

An apparatus for adjusting the height of a basketball goal comprising a telescoping support pivotally mounted to form a diagonal within a deformable parallelogrammatic structure. The telescoping support has an outer cylinder slidably connected over a concentric inner cylinder. The inner cylinder has a slot with a plurality of notches on its underside and the outer cylinder has a post disposed inside the outer cylinder and in sliding engagement with the slot. The inner cylinder is pivotally mounted such that it may be rotated about its longitudinal axis enough to align the post with either a notch or the slot. The notches are configured such that when a notch engages the post, the telescoping support is held and restricted from extending. A release mechanism is provided to rotate the inner cylinder causing the notch to disengage the post and to align with the slot for sliding engagement with the post. So aligned, the telescoping support may be altered in length thereby changing the shape of the deformable parallelogrammatic structure and raising or lowering the basketball goal.

The method of the present invention allows a user equipped with a pole and standing on the basketball playing surface to rotate the inner cylinder using the pole. The user may then raise or lower the basketball goal to the desired height using the pole. Upon removal of the pole, the telescoping support locks into position.

63 Claims, 2 Drawing Sheets

METHOD AND APPARATUS FOR ADJUSTING A BASKETBALL GOAL

BACKGROUND

1. Field of the Invention

The present invention relates to a method and apparatus for adjusting the height of a basketball goal.

2. The Background of the Invention

Because of the popularity of the sport of basketball, particularly in the United States, many people, especially families, mount a basketball goal on their property. This allows them to have ready access to a basketball goal to enjoy the sport of basketball.

Children, however, frequently find it frustrating to learn how to play basketball because the standard height of a basketball goal is ten feet and it is often difficult for children to throw the basketball that high. Thus, many families with small children find it desirable to install a basketball goal at a height which is much lower than the standard height. Indeed, families with many small children may be forced to sacrifice having a basketball goal at the standard height, which is suitable for adults, so that the children may more easily develop their basketball skills and more fully enjoy the game.

Although many small children have the ability to throw the basketball through the goal, this is usually only accomplished by exerting extreme effort, often at the expense of proper form. Many people never develop proper shooting form because, as small children, they developed an incorrect form because that was the only way they could throw the basketball high enough to reach the basket. Hence, another advantage of having a basketball goal at a lower height is that smaller children may learn proper basketball skills and practice shooting the basketball with correct form. Thus, the child does not have to relearn skills as he becomes stronger.

It will be appreciated by anyone with a knowledge of the sport of basketball that one of the most envied abilities associated with the sport is the ability to "dunk" the basketball. One dunks the basketball by throwing the basketball into the basketball goal from a position above the rim of the goal. Obviously, one must be extremely tall and/or possess an extraordinary leaping ability in order to position himself high enough to be able to dunk the basketball.

While many people are able to develop excellent basketball skills, it will be appreciated that very few people have the natural leaping ability and/or height to be able to dunk the basketball. So that one may be able to develop skills and practice different styles of dunking the basketball, it is often desirable to place the basketball goal at a height somewhat lower than the standard height. However, it is not usually practical to permanently mount a basketball goal at a lower height simply for the purpose of dunking the basketball. It is also not practical to have two basketball goals, one at the standard height and one at a lower height. Hence, most basketball goals are simply mounted at the standard height.

Because of the reasons mentioned above, many attempts have been made to design a basketball goal which is adjustable to several different heights. One design of an adjustable basketball goal employs a flexible cable and a pulley which can be operated to raise or lower the goal to the desired height. The goal is then affixed at that height by tying off the cable. Disadvantages to this type of design are that adjustment is very slow and the cable often experiences a short life span because of its constant exposure to the weather. Thus, because of the extreme amount of tension placed on the cable when the basketball goal is being used, especially when one dunks the basketball or hangs on the rim of the basketball goal, the cable could break. As the cable continually becomes weaker due to its constant exposure to a variety of weather conditions, the amount of tension required to break the cable gradually decreases until the actions of someone playing basketball are enough to cause the cable to break. When the cable does break, the break is usually caused by the actions of people using the goal. These people are endangered, and serious injury could result if they are in the path of the goal when the cable breaks should the goal fall to its lowest position.

Another design for an adjustable goal employs pivotally mounted parallel bars which connect the basketball backboard to a rigid mounting device such as a pole. The parallel bars combine with the basketball backboard and the rigid mounting device to form a parallelogram. Since the bars are pivotally mounted, they allow the backboard of the basketball goal to move to several different heights while remaining vertically disposed. Typically, once the basketball goal is at the desired height, it is secured in place by tightening one or more bolts which "lock" the parallelogram in place.

One of the disadvantages of this device is that whenever one desires to adjust the backetball goal, it requires the use of a ladder or similar device to enable one to reach the one or more bolts which must be loosened to "unlock" the basketball goal. This is complicated by the fact that when the bolt or bolts are loosened, the person adjusting the goal must support the entire weight of the goal until the goal has been set to the desired height and the bolt or bolts are tightened again. This can be both a strenuous and a dangerous task and may be impossible physically for many small children to perform. This is an unfortunate disadvantage because it is usually small children who have the greatest need for lowering the basketball goal. Yet another significant disadvantage of this type of design is that if the bolt or bolts become loosened through vibration or other means while the basketball goal is in use, the goal will fall to its lowest position, striking whomever may be in its path.

Yet another design for an adjustable basketball goal employs the same parallelogrammatical structure as the previously discussed design except a telescoping ratchet mechanism is employed, rather than a bolt or bolts, to secure the basketball goal in the desired position. As the goal is raised, a hinged pawl on one member engages a row of apertures in a second telescoping member, seriatim in a rachet-like fashion. The configuration of the pawl permits the goal to be raised by applying an upward force to the basketball backboard, but the pawl will engage one of the apertures preventing downward movement if the upward force is removed. When the desired height is reached, the upward force is released and the pawl engages the aperture to which it is aligned preventing the goal from falling due to its own weight. From any of the intermediate height positions, the goal can be raised to a higher position, but it cannot be lowered to a lower position without neutralizing the pawl because the pawl will engage the nearest aperture preventing downward movement. To neutralize the pawl, the goal must be raised to its highest position, a position higher than the highest usable level for the goal, where the pawl engages an ear which cocks the pawl into a neutral position. With the pawl so neutralized, the basketball goal may be lowered because the pawl will not engage any apertures during the descent of the goal. As the goal reaches its lowest position, the pawl engages another ear which releases or trips the pawl back to its original, active position where it may again engage any of the apertures and secure the goal at the desired height.

One disadvantage of this design is that in order to lower the basketball goal one level, the goal must first be raised to its highest position where the pawl is neutralized before the basketball goal may be lowered. Then, the goal must be lowered to its lowest position in order to trigger and activate the pawl so that it may engage again the apertures. Finally, the basketball goal is raised to the desired position and the pawl secures that position by resting within the aperture corresponding to the desired height. If, however, the basketball goal is inadvertently raised one position too high, the pawl will not permit lowering the goal and it must again be raised to the extreme uppermost position to neutralize the pawl. The goal is then lowered to the extreme lowest position in order to activate the pawl so that the user can once again attempt to position the pawl to engage the desired aperture.

Because the pawl is neutralized only at the extreme uppermost position, this gives rise to another significant and possibly dangerous disadvantage. If, when the goal is at its highest usable level, a person dunks the basketball and momentarily hangs on the rim of the basket, the entire goal will spring upwardly upon release of the rim. If this upward force is substantial, the goal may spring upwardly causing the pawl to strike the ear which cocks the pawl into the neutral position. Neutraling the pawl permits the basketball goal to crash to its lowest position, possibly injuring persons involved in the basketball game.

In order to reduce the danger in the potentially dangerous crashing of the basketball goal, a fluid cylinder has been used to prevent the basketball goal from rapidly falling when the pawl is neutralized. However, the fluid cylinder introduces a delay into the time it takes the basketball goal to be adjusted to the desired height because the assent and descent speed is retarded by the fluid cylinder. Additionally, the fluid cylinder does not prevent the pawl from being cocked into its neutral position under the conditions just described, nor does it obviate the necessity of having to readjust the height of the basketball goal when the pawl is neutralized and the basketball goal descends to its lowest height. Further, because the fluid cylinder is a separate accessory from the rachet mechanism, the user may choose not to install it or the user may remove it if it becomes damaged or broken.

As an added precaution to reduce the potential for injury, a safety locking mechanism employing a tightening bolt has also been used to rigidly secure the height of the goal having adjustability provided by the ratchet mechanism described above. However, the basketball goal is often used without tightening the bolt to lock the ratchet mechanism in place because tightening the bolt would require employing a ladder to enable the user to reach the bolt. Furthermore, the bolt typically is at a height higher than the rim of the basket; hence, the higher the basketball goal is placed, the less likelihood there is that the user of the goal will be able to reach the bolt in order to secure the goal. Consequently, when the goal is at the standard height of ten feet, the bolt is positioned over ten feet high. Thus, the locking mechanism is least likely to be employed when the basketball goal is set at the highest usable level. It is at this level that it is critical to employ the locking mechanism to prevent the pawl from becoming neutralized inadvertently and the basketball goal from crashing to its lowest position.

It will be appreciated, therefore, that what is needed in the art are methods and apparatus for adjusting the height of a basketball goal which do not pose a danger to those who may use the device, are easily adjustable from one height to another without employing a ladder or similar device, and are durable and able to withstand constant exposure to a variety of weather conditions.

BRIEF SUMMARY AND OBJECTS OF THE INVENTION

The present invention includes novel methods and apparatus for adjusting a basketball goal. The invention uses a parallelogrammatic structure to facilitate the adjustability of the basketball goal. The present invention has an adjustable telescopic support comprising two telescoping cylindrical members which can be selectively secured with respect to each other whereby a person of any height, without the use of a ladder or similar device, may adjust the height of the basketball goal. Further, the present invention does not permit the basketball goal to crash to its lowest position either when the basketball goal is in use or when it is being adjusted.

The apparatus of the present invention utilizes a deformable parallelogrammatic structure comprising upper and lower support members pivotally mounted at one end to a vertically disposed rigid support, such as a pole or a wall, and at the other end to a mounting plate upon which a basketball backboard may be mounted. The parallelogrammatic structure is deformable in that each vertex for the structure is a pivot joint which allows the structure to change its shape while maintaining the characteristics of a parellelogram. Because of the nature of a parallelogram, the mounting plate upon which the upper and lower support members are pivotally mounted maintains a vertical disposition as it moves through an arc from its lowest position to its highest position as a consequence of the rigid support opposite the mounting plate being vertically disposed. In this manner, the basketball goal may be affixed to the mounting plate and the mounting plate will maintain the backboard vertical and the rim horizontal as the goal is adjusted up and down as desired.

The mounting plate is securely disposed in a selected position by means of the adjustable telescopic support which comprises two cylindrical members, one fitting concentrically within the other in a telescoping fashion. Preferably, the outer cylinder is pivotally mounted to the upper support member at or near the rigid support. The inner cylinder is pivotally mounted to the lower support member at or near the mounting plate, such that the two telescoping cylindrical members form substantially a diagonal to the parallelogram. The adjustable telescopic support is capable of adjusting its length to correspond to the length of a diagonal of a parallelogram as the mounting plate side of the parallelogrammatic structure is raised or lowered.

The inner cylinder has a longitudinal slot on its underneath side. The slot has several notches, each disposed in spaced relationship to the others along one side of the slot. A post is firmly mounted to the inside of the outer cylinder and the two cylinders are concentrically connected such that the post slidably engages the slot as the inner cylinder slides in and out of the outer cylinder in a telescoping fashion. The notches are configured to receive the post and secure it from movement within the slot when a downward force (such as the force of gravity) is applied at the mounting plate, while permitting release from the notch and movement within the slot when a sufficient upward force is applied at the mounting plate. The inner cylinder is biased, as is further explained below, such that whenever a notch is aligned with the post, the notch will receive the post. In this manner, the post will not release from the notch within which it is disposed and allow the basketball goal to crash down to its lowest position. Disengagement of the post from such notch is accomplished by either a sufficient upward force applied at the mounting plate or by actuating a latching mechanism.

The latching mechanism, when actuated, causes the inner cylinder to rotate about its longitudinal axis. This rotating movement causes the post to disengage the notch within which it is disposed and positions the post for longitudinal sliding movement within the slot. Although the latching mechanism can be connected in a fashion to rotate either the inner or the outer cylinder, for the purposes of this brief summary of the invention the latching mechanism will cause rotation of the inner cylinder. The latching mechanism comprises a lever plate with a release cup disposed at one end and a catch at the other end. The lever plate is pivotally mounted on brackets near the nontelescoping end of the inner cylinder. The catch engages a rocker arm secured to the end of the inner cylinder.

The inner cylinder is pivotally mounted such that it is capable of a certain degree of rotation about its longitudinal axis which is accomplished by depressing the release cup. As the release cup is depressed, the catch at the opposite end of the lever plate engages one end of the rocker arm which transfers force from the depression of the release cup to the rocker arm thereby causing the inner cylinder to rotate. The rotation of the inner cylinder moves the notches relative to the post to align the slot with the post thereby permitting the inner cylinder to slide freely inside the outer cylinder. The lever plate is biased so that when the depressing force to the release cup is removed, the inner cylinder rotates back to its original position thereby forcing the inner cylinder to rotate such that the post may engage a notch.

When it is desired to lower the height of the basketball goal, a long rod or similar implement may be used to depress the release cup. Depressing the release cup rotates the inner cylinder and disengages the post from the notch, allowing the goal to freely move up or down while the post slides along the slot. When the goal has been lowered to the desired height, the rod is removed from the release cup causing the inner cylinder to rotate such that the post engages the notch corresponding to that particular height. Because the lever plate is biased, it will return to its nondepressed position upon removal of the rod causing the inner cylinder to rotate back to a position for securely receiving the post in a notch. This consequent rotation occurs to prevent the force of gravity from causing the basketball goal to fall beyond the next lower height because the post engages the notch corresponding to that next lower height. Thus, the latching mechanism acts as an added safety feature in that inadvertent actuation of this latching mechanism or rapid removal of the depressing force to the release cup causes the basketball goal to fall only to the next lower position and not crash to the lowest position.

In raising the basketball goal to a selected height from among various predetermined heights, the rod is placed in a guide which is located near the mounting plate. The guide merely serves to provide a place close to the mounting plate where an upward force may be applied without the rod slipping. After placing the rod in the guide, a force sufficient to raise the goal is applied to the goal via the rod. Because of the configuration of the notches, as the basketball goal is raised, the inner cylinder is forced to rotate as the post slides out of the notch and into the slot so that the goal may be advanced to the next higher position. The side of the slot which has the notches remains biased against the post so that when the goal is raised to the position where the next notch is aligned with the post, the inner cylinder, acting under the biasing force of a spring or the like, immediately engages the notch with which it is aligned. Consequently, as each notch is encountered, the post engages the notch and the goal will rest at the predetermined height corresponding to that notch. As a continued upward force is applied, the post will disengage the notch within which it is resting and then advance to the next notch and each successive notch until the desired height is obtained.

An alternative method of raising the goal is to follow substantially the same procedure explained above for lowering the goal; that is, depressing the release cup with the rod, raising the goal to the desired height, and rapidly withdrawing the rod from the release cup. Because the goal can freely move up to down when the release cup is depressed, care must be taken to remove the rod from the release cup while not allowing the goal to drop below the desired height. When the rod is removed from the release cup, the lever plate immediately returns to its nondepressed position under the biasing force of the spring. This, in turn, forces the inner cylinder to rotate and engage the post with which the notch in the inner cylinder is aligned.

The backboard of the basketball goal is secured to the mounting plate such that it extends below the mounting plate to act substantially as a shield for the release cup. This prevents an errant basketball from depressing the release cup during normal play. Even if the release cup is inadvertently hit with the ball, the biased release cup is only momentarily depressed and the basketball goal will drop, if at all, only one position.

It is, therefore, a primary object of the present invention to provide an apparatus for adjusting a basketball goal in such a way that the adjustable telescopic support does not become completely disengaged when a force is applied to the basketball goal and then suddenly released, such as is often the case when the basketball is dunked.

It is a further object of the present invention to provide such methods and apparatus so that the basketball goal may be adjusted from one level to the next without having to perform complicated maneuvers.

It is an additional object of the present invention to provide an apparatus wherein normal use of the basketball goal will not cause the adjustable telescopic support to become disengaged resulting in the basketball goal falling to its lowest position.

It is a further object of the present invention to provide such methods and apparatus wherein the basketball goal may be adjusted without the use of a ladder or similar device.

Another object of the present invention is to provide an apparatus for adjusting the height of a basketball goal that is durable and resistant to a variety of changing weather conditions.

Still another object of the present invention is to provide an adjustable basketball goal that is easily adjustable and poses no danger to those who are adjusting the basketball goal or those who are playing basketball with the goal.

Other objects of the present invention may become apparent by reference to the drawings, the detailed description of the invention and the claims set forth herein.

DETAILED DESCRIPTION OF THE PREFERRED EMBODIMENTS

The present invention is directed to an apparatus for adjusting the height at which a basketball goal is set. The apparatus is designed to enable any person, including smaller children, to quickly and safely adjust the height of a basketball goal, and to prevent the inadvertent and undesirable crashing of the goal down to its lowest height.

Figure 1:
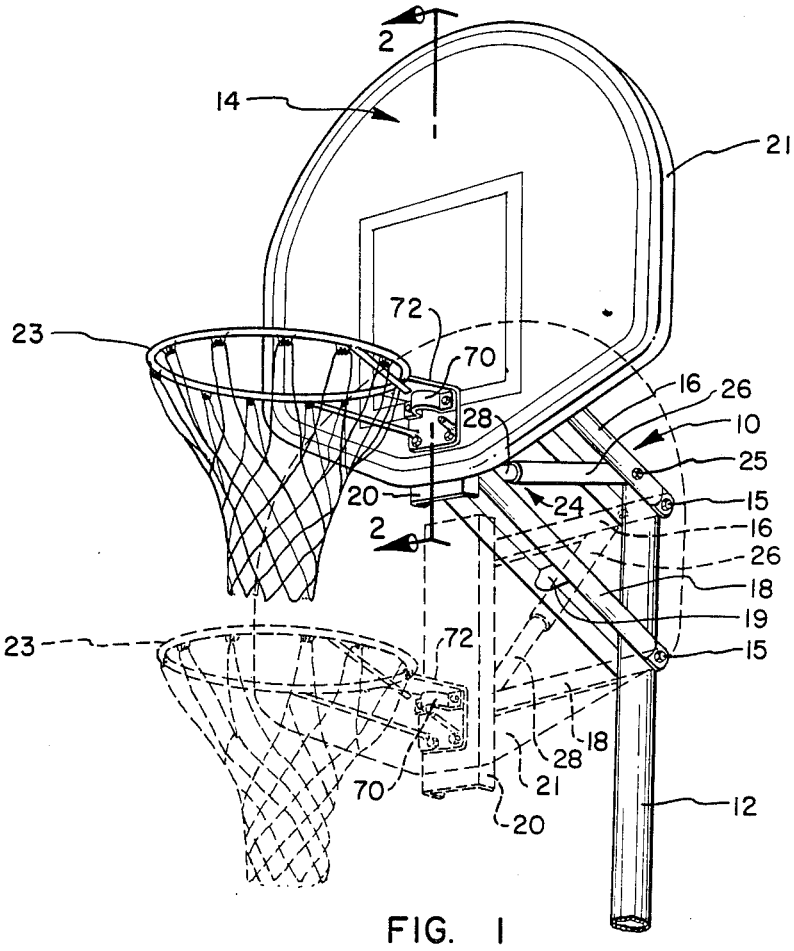
FIG. 1 is a perspective view of a parallelogrammatic structure utilizing the present invention and having a basketball goal mounted thereon and disposed so that the basketball goal is at its highest usable position. The phantom lines show the structure of the present invention as it would appear in its lowered position.

Reference is now made to the figures wherein like parts are referenced by like numerals throughout. With particular reference to FIG. 1, an adjustable support system of the present invention is generally designated 10. The adjustable support system 10 comprises a deformable parallelogrammatic structure which is pivotally connected to a rigid support 12 on one side of the structure and to a conventional basketball goal 14 on the other side. As shown in FIG. 1, the adjustable support system 10 may be connected directly to the rigid support 12 by means of hinge bolts 15. The adjustable support system 10 may be connected to the rigid support 12 by any of several methods, which are more fully discussed below, so long as the adjustable support system 10 is pivotally connected to the rigid support 12.

Figure 2:
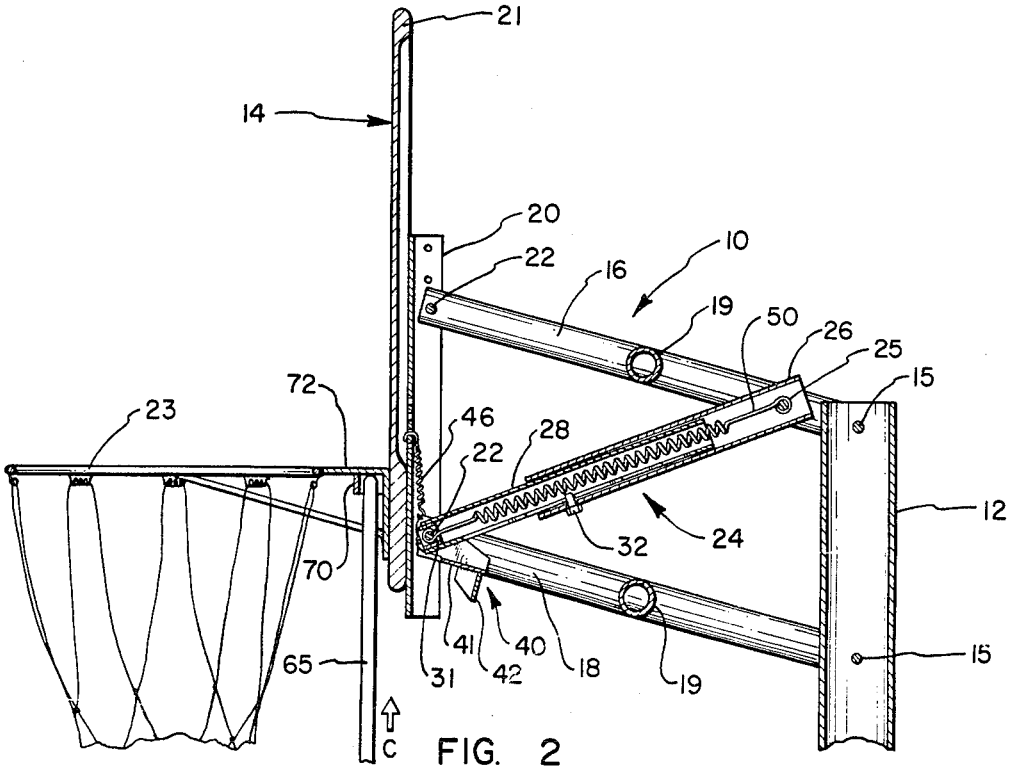
FIG. 2 is a cross-sectional view taken along line 2—2 of FIG. 1.

As can best be seen in FIGS. 1 and 2, the adjustable support system 10 comprises an upper support 16, and a lower support 18. The upper and lower supports 16 and 18 may be comprised to two spaced structural pieces. The two structural pieces may be braced by means of a bracing member 19. It will be appreciated that these structural members may comprise any configuration sufficient to satisfy the structural limitations necessitated by the present invention. As seen in FIG, 2, the upper support 16 and the lower support 18 are pivotally mounted to a mounting plate 20 via pivot pins 22 on one end and pivotally mounted to the rigid support 12 via hinge bolts 15 at the other end. Upper support 16 and lower support 18 must be mounted so that they remain substantially parallel to each other as they pivot, changing the general configuration of the parallelogram defined by the rigid support 12, the upper support 16, the lower support 18 and the mounting plate 20. In this manner, as the configuration of the so-defined parallelogram changes with the raising or lowering of the mounting plate 20, the configuration remains a parallelogram and the mounting plate 20 remains vertically disposed because the rigid support 12 is vertically disposed.

Although the presently preferred embodiment of the present invention employs the use of mounting plate 20, the upper support 16 and lower support 18 may be mounted directly to the basketball goal 14. Instead of mounting the basketball goal 14 directly to the rigid support 12, as would be done in the absence of the present invention, for ease of construction, the basbetball goal 14 is mounted to the mounting plate 20. The basketball goal 14 may be of the type conventionally known in the art, comprising a backboard 21 and a rim or hoop 23.

The adjustable support system 10 further comprises an adjustable telescopic support 24 which is pivotally connected to form substantially a diagonal in the so-defined parallelogram. While it is preferred that the telescopic support 24 be connected near the point where the lower support 18 is connected to the mounting plate 20 on one end and connected near the point where the upper support 16 is connected to the rigid support 12 at the other end, the present invention will also function with telescopic support 24 forming the other diagonal; that is, mounted at one end near where the upper support 16 is mounted to the mounting plate 20 and at the other end near where the lower support 18 is mounted to the rigid support 12.

As illustrated in the drawings, it is presently preferred that one end of the telescopic support 24 be pivotally mounted to the mounting plate 20 utilizing the lower pivot pin 22 to which the lower support 18 is mounted. It is also presently preferred that the opposite end of the telescopic support 24 be pivotally mounted to the upper support 16 utilizing a hinge pin 25 offset a short distance from where the upper support 16 is mounted to the rigid support 12. This configuration is designed to maximize the amount the basketball goal 14 may be raised and lowered while minimizing stress on the structure. Although the telescopic support 24 may be connected directly to the rigid support 12, the rigid support 12 would have to be modified so that the body of the telescopic support 24 would not collide with the rigid support 12 as the basketball goal 14 is raised or lowered. It will be appreciated by one skilled in the art that the adjustable support system 10 may function with the telescopic support 24 mounted at different positions along the parallelogrammatic structure. However, it is presently believed that the configuration illustrated in FIG. 2 is the most efficient configuration for accomplishing the objectives of the present invention.

Figure 3:
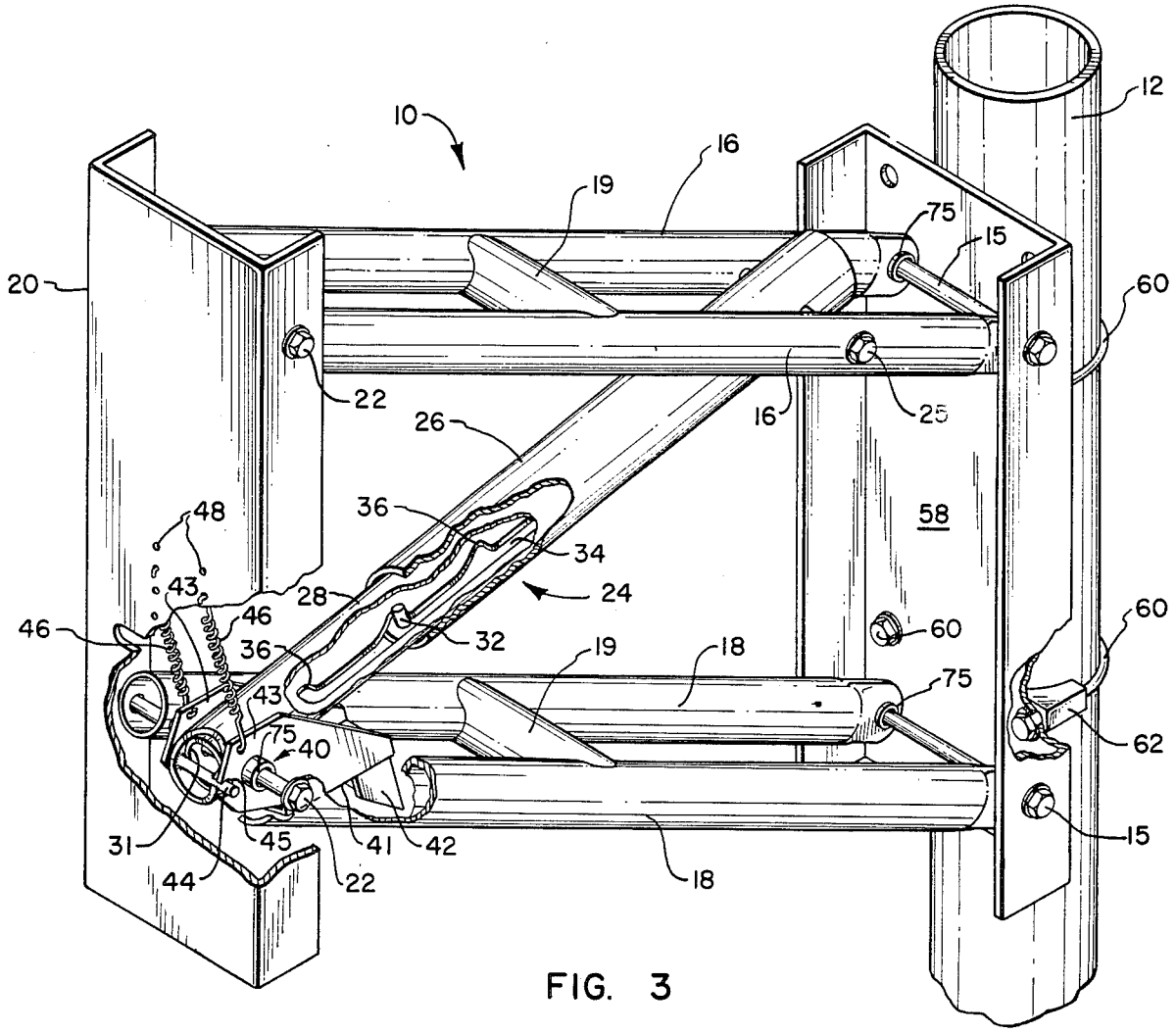
FIG. 3 is a perspective view of the present invention showing portions of the adjustable telescopic support broken away to more fully illustrate the construction and operation of its various parts, which also demonstrates an alternative means of mounting the parallelogrammatic structure to a rigid support.

Referring now to FIG. 3, the different components which comprise the telescopic support 24 will be explained. The telescopic support 24 comprises an outer cylinder 26 and an inner cylinder 28. In the presently preferred embodiment of the invention, the outer cylinder 26, as described above, is pivotally mounted at one end to the upper support 16. The other end of the outer cylinder member 26 acts as a sleeve in which one end of the inner cylinder 28 is inserted for slidable engagement. The other end of the inner cylinder 28 is pivotally mounted to the mounting plate 20 in a manner similar to the way the lower support member 18 is pivotally mounted, and preferably to the same pivot pin 22. In order to permit limited rotation of the inner cylinder 28 about its longitudinal axis, elongated bores 30 (shown in FIG. 4) are provided on opposite sides of the inner cylinder 28 near its mounted end. The pivot pin 22 extends through each of the elongated bores 30. A sleeve 31 is also provided which is a short piece of cylindrical tubing disposed within the inner cylinder 28 at its pivot end to maintain the concentric disposition of the inner cylinder 28 with respect to the outer cylinder 26.

It will be appreciated that the present invention will function regardless of whether the telescopic support 24 is mounted as shown in FIG. 3 with the outer cylinder 26 in the higher position or whether the telescopic support 24 is positioned with the inner cylinder 28 mounted in the higher position. However, it is presently preferred that the outer cylinder 26 be mounted in the higher position as illustrated in FIG. 3. In this manner, the telescopic support 24 is disposed such that it angles downward from its pivotally mounted end to the end that slidably engages the inner cylinder 28. Hence, precipitation in the form of rain, snow or the like is virtually prevented from entering the interior of the telescopic support 24 through the small space between the outer cylinder 26 and the inner cylinder 28 where they meet in slidable engagement.

The inner cylinder 28 has a slot 34 which extends substantially longitudinally along the inner cylinder 28. A plurality of notches 36 are provided spaced along one side of the slot 34. The outer cylinder 26 is provided with a post 32 affixed to the inside of the outer cylinder 26 such that the post 32 slides freely within the slot 34 of the inner cylinder 28 as the telescopic support 24 is extended and contracted. It will also be appreciated that it is possible to configure the telescopic support 24 such that post 32 is affixed to the inner cylinder 28 with slot 34 in the outer cylinder 26. With either configuration, in order to reduce the amount of exposure to the elements, it is presently preferred that the slot 34 and the post 32 be placed on the underside of the telescopic support 24.

Figure 4:
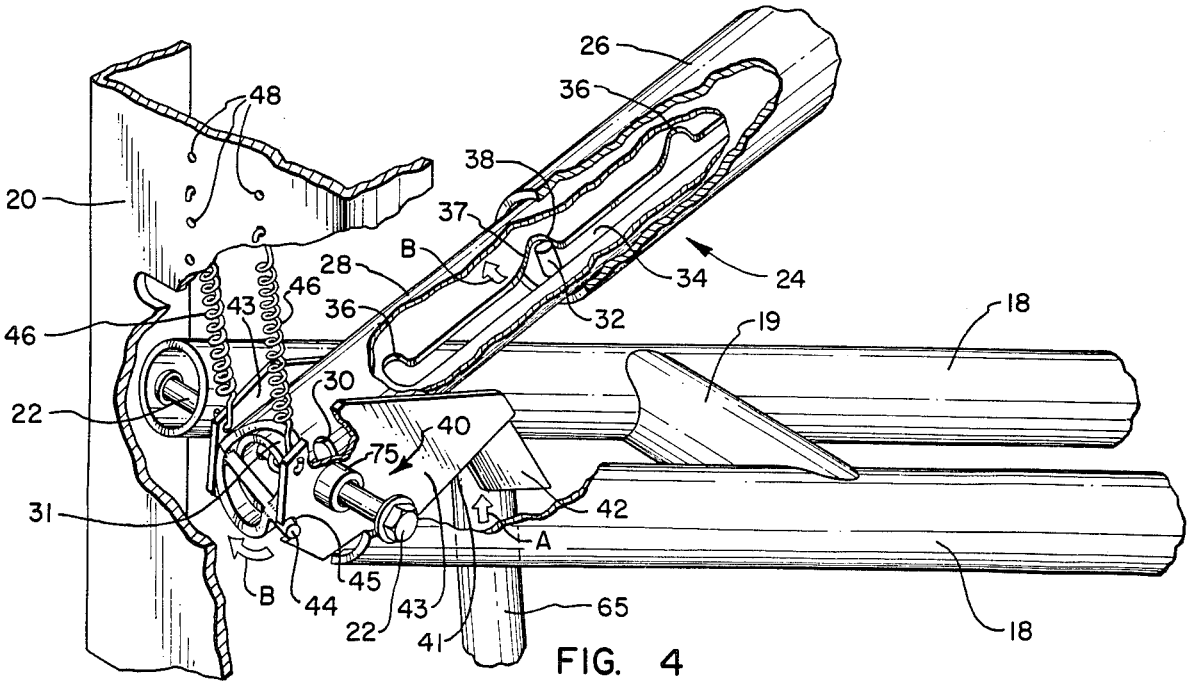
FIG. 4 is a perspective view of a portion of the present invention wherein the lever plate has been actuated, thus illustrating the rotating relationship between the two cylinders, with portions broken away to more fully illustrate the operation of the various parts.

As illustrated in FIG. 4, the notches 36 in the side of the slot 34 should be configured to have a bevelled side 37 and a stop side 38. The stop side 38 is substantially perpendicular to the side of the slot 34 or may have a slightly concave curvature so that when a downward force (e.g., gravity) is applied to the basketball goal 14 placing tension on the telescopic support 24 to extend its length, the post 32 engages the stop side 38 of a notch 36 and rests there which prevents the telescopic support 24 from lengthening. The bevelled side 37 of the notches 36 are configured so that when an upward force is applied to the basketball goal 14 which causes a compression force on the telescopic support 24, the post 32 is pushed against and advances along the bevelled side 37 of the notch 36 causing the inner cylinder 28 to rotate. As the post 32 exists the notch 36, it aligns with the slot 34 in slidable engagement thereby permitting the telescopic support 24 to contract.

A latching mechanism, generally designated as 40, is provided to initiate rotation of the inner cylinder 28 which releases the post 32 from the notch 36 it occupies. When the inner cylinder 28 rotates sufficiently to position the post 32 in the slot 34, the basketball goal 14 may be raised or lowered as the post 32 freely slides within the slot 34.

The latching mechanism 40 preferably comprises a lever plate 41 having a release cup 42 and brackets 43 used for pivotally mounting the lever plate 41. The brackets 43 are preferably mounted to the lower pivot pin 22 such that the mounting acts as a fulcrum for the lever plate 41. In this manner, a force applied at the release cup 42 will depress that end of the lever plate 41 causing the opposite end to move correspondingly in the opposite direction.

To transfer the depressing force applied at the release cup into rotation of the inner cylinder 28, a rocker arm 44 is provided which is disposed at the pivoting end of the inner cylinder 28. A portion of the rocker arm 44 extends beyond the circumference of the inner cylinder 28 and is disposed to engage the lever plate 41 at a catch 45. The catch 45 is designed to transfer force applied at the release cup 42 end of the lever plate 41 to the extended portion of the rocker arm 44. As can best be seen in FIG. 4, a force applied at the release cup 42 in the direction of arrow A depresses that end of lever plate 41. Correspondingly, the opposite end of lever plate 41 moves in the opposite direction of arrow A, and the catch 45 which is disposed at that opposite end exerts a force on the captured extended end of the rocker arm 44. That consequent force translates into rotation of the inner cylinder 28, to the extent permitted by elongated bores 30, in the direction of arrow B.

To return the release cup 42 to its nondepressed position once the force is removed, latch springs 46 are provided which are connected to the catch 45 end of the lever plate 41 and to the mounting plate 20. Such latch springs 46 provide the biasing which also causes the inner cylinder 28 to rotate back to the position at which the post 32 will rest within a notch 36.

Although two latch springs 46 are shown in the drawings, it should be understood that one or more such latch springs 46 or any appropriate type of biasing member, such as elastic or the like, can be used. By using one latch spring 46 the tension applied to the lever plate is less than using two such latch springs 46. Conversely, by using more than two latch springs 46, the tension can be increased. The presently preferred embodiment of the invention, as illustrated, also includes rows of spaced holes 48 to which the latch springs 46 may be anchored. This provides a method by which the tension in the latch springs may be adjusted by increasing or decreasing the length to which the latch springs 46 are stretched. The number of latch springs 46 and the number of rows of holes 48 is not critical so long as whatever biasing means is used has sufficient strength to return the lever plate 41 to its nondepressed position.

Within the telescopic support 24, a counterbalance spring 50 is provided which extends between and is anchored to the lower pivot pin 22 and the hinge pin 25. The counterbalance spring 50 (shown only in FIG. 2) reduces the force which must be applied to the basketball goal 14 in order to adjust the length of the telescopic support 24. Although the counterbalance spring 50 may be disposed outside the telescopic support 24 and still function to reduce the force needed to adjust the basketball goal 14, it is preferred that it be disposed within the telescopic support 24 where it is shielded from the elements and where the danger of pinching a user is eliminated.

Although the apparatus shown in FIGS. 1 and 2 and shows the basketball goal 14 as it might be newly constructed, the present invention may also be retrofit to an existing basketball pole. This can be done in at least two ways. First, as shown best in FIG. 1, the upper support 16 and the lower support 18 may be pivotally mounted by means of hinge bolts 15 to the existing pole. Alternatively, as shown in FIG. 3, the upper support 16 and the lower support 18 may be pivotally mounted to a rigid support plate 58 which is in turn secured to the existing pole by means of U-bolts 60 and a saddle clamp 62 or any other method commonly known by which the rigid support plate 58 may be rigidly secured to an existing pole. The rigid support plate 58 provides an additional advantage that it can be used to correct an improperly installed basketball pole. It is not uncommon for a basketball pole to be installed, particularly when a nonadjustable goal is used, where the pole is set too deep or it is turned such that the backboard 21 does not squarely address the playing area. With the rigid support plate 58, the basketball goal 14 can be raised or lowered with respect to the pole 12 by minute increments. Also, the angle at which the backboard 21 addresses the playing area may be adjusted. A further advantage of the rigid support plate 58 is that it can also be used to mount the present invention against a wall or other permanent wall-like structure. Thus, the present invention is not limited to use with a pole.

Operation of the present invention is quick and easy. The method employed to adjust the present invention depends on whether it is desired to raise or lower the basketball goal 14. To lower the height of the basketball goal 14, a long rod 65 is used to engage and depress the release cup 42. As the release cup 42 is depressed by pushing it in the direction shown by arrow A, as illustrated in FIG. 4, the lever plate 41 rocks on its fulcrum mounting causing the catch 45 to engage and to move the extended end of rocker arm 44 in the direction of arrow B. This forces the inner cylinder 28 to also rotate in the direction as is shown by arrow B. As the inner cylinder 28 rotates, because the outer cylinder 26 remains stationary from rotation about its longitudinal axis, the rotation of the inner cylinder 28 disengages the post 32 from the notch 36 and places the post 32 within the slot 34 of the inner cylinder 28. Compare FIGS. 3 and 4. In this position, the inner cylinder 28 is free to slide within the outer cylinder 26 in a telescoping fashion without the post 32 engaging any notches 36.

When the inner cylinder 28 is rotated to the position illustrated in FIG. 4, the basketball goal 14 may freely be lowered to the desired height. This is done by lowering the rod 65 while ensuring that the release cup 42 remains depressed. The speed at which the basketball goal 14 may be lowered while maintaining the release cup 42 in a depressed position is controlled by manipulation of the rod 65, friction in the pivotal joints, and the tension in the counterbalance spring 50. If the rod 65 is quickly removed from contact with the release cup 42 before the basketball goal 14 has been fully lowered, the release cup 42 will return to its nondepressed position, causing the inner cylinder 28 to rotate such that one of the notches 36 engages the post 32. This halts the continued descent of the basketball goal 14. Thus, in lowering the goal 14 to a desired position, the rod 65 can be quickly removed from the release cup 42 when the goal 14 is just above the desired height. The lever plate 41 under tension from the latch springs 46 then returns to its biased passive position and the inner cylinder 28 is forced to rotate in the opposite direction of arrow B thereby returning a notch 36 for secure engagement with the post 32 without allowing the goal 14 to drop to a lower height.

An alternative method for lowering the height of the basketball goal 14 involves depressing the release cup 42 portion of lever plate 41 so that the post 32 disengages the notch 36 and is positioned in slot 34. The goal 14 is then lowered to the lowest height permitted by the telescopic support 24 where the rod 65 used to depress the release cup 42 can be removed. The goal 14 is then raised to the desired height in a manner described hereinafter.

To raise the height of the basketball goal 14, an upward force sufficient to overcome gravity and minor frictional resistance is applied to the basketball goal 14. It should be appreciated that the force which must be applied to raise the basketball goal 14 may be applied at virtually any point on the basketball goal 14 or the adjustable support system 10. However, the greater the horizontal distance between where the force is applied and where the upper support 16 and the lower support 18 are pivotally mounted to the rigid support 12, the lesser the force required to raise the basketball goal 14. For this purpose, it is preferred that a guide loop 70 is positioned on the underside of the brace portion 72 of the basketball rim 23, as shown in FIG. 1. This guide loop 70 provides a holder for the end of a rod 65 used to apply the upward force (see arrow C) to the basbetball goal 14. The guide loop 70, like the release cup 42, holds the end of the rod 65 to prevent slipping so that the force is applied to the desired area.

With the preferred embodiment of this invention, raising the goal 14 causes the telescopic support 24 to contract in length. This contraction of the telescopic support 24 forces the post 32 against the bevelled side 37 of whichever notch 36 within which the post 32 is positioned. As this force of such contraction overcomes the biasing of the inner cylinder 28 by sliding movement of the bevelled side 37 against the post 32, the inner cylinder 28 rotates in the direction of arrow B (as illustrated in FIG. 4). The post 32 disengages the notch 36 and advances within the slot 34 to the next notch 36 which is then engaged by the post 32 due to the balancing of the inner cylinder 28. A continued upward force causing further contraction of the telescopic support 24 causes the post 32 to disengage a notch 36, advance along the slot 34, and engage the next adjacent notch 36, until the desired height of the basketball goal 14 is obtained.

Referring now to FIGS. 3 and 4, it is also possible to raise the basketball goal 14 by depressing release cup 42 with a stick or a pole as is described above for lowering the basketball goal 14. As the release cup 42 is depressed, the resultant rotation of the inner cylinder 28 frees the post 32 from the notch 36. A continued upward lifting force on the release cup 42 advances the post 32 along the slot 34. As the post 32 aligns with the notch 36 corresponding to the desired height of the basbetball goal 14, the rod 65 is quickly removed from the release cup 42 and the latch springs 46 cause rotation of the inner cylinder 28 which positions the post 32 in secure engagement with notch 36 before the force of gravity causes the basketball goal 14 to fall to a lower position. If the post 32 does not engage the desired notch 26, it will merely slide along the slot 34 until it engages the next notch 26. In no case will the present invention allow the basketball goal 14 to fall more than the height corresponding to the movement of the post 32 from one notch 36 to the next notch 36.

Consequently, an inadvertent striking of the release cup 42 with a basketball or other object, thereby temporarily depressing the release cup 42, causes only momentary rotation of the inner cylinder 28. Thus, if the post 32 does become disengaged from the notch 36, the telescopic support 24 will only expand until the post 32 comes into contact with the next notch 36. The biasing of the inner cylinder 28 causes a return rotation that positions the post 32 in the next notch 36 and prevents further descent of the basketball goal 14.

To facilitate the efficient operation of the adjustable support system 10 and reduce the effort needed to adjust the height of the basketball goal 14, bushings and spacers 75 made of friction reducing materials such as galvanized steel or polymers may be used at the pivoting connections described above. Such bushings and spacers reduce friction and increase the life of the system 10.

Further, although the present invention in shown as used with a basketball goal 14, as illustrated in FIGS. 1 and 2, it will be appreciated that the present invention may be used in any application such as volleyball nets, etc. wherein it is desired to adjust the height of an object to predetermined heights when to do so presents at least some of the problems the present invention is designed to overcome.

From the foregoing, it will be appreciated that the present invention provides a method and apparatus for quickly and safely adjusting a basketball goal or other object while avoiding the problems inherent in other adjustable basketball standards. The present invention avoids the significant safety hazards encountered by others, such as the possibility that the basketball goal may fall to its lowest position when the basketball is dunked. The present invention may be adjusted to various predetermined heights without having to perform complicated or dangerous maneuvers and adjustments may be accomplished without the use of a ladder or similar device.

It should be appreciated that the apparatus and methods of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by U.S. Letters Patent is:

1. An adjustable basketball goal system for adjustment of the height of a basketball goal above a playing surface, comprising:

a deformable parallelogrammatic structure;

means for securing the basketball goal to said parallelogrammatic structure;

means for securing said parallelogrammatic structure to a rigid vertical support such that said parallelogrammatic structure is suspended above the playing surface; and a telescoping support, said telescoping support being slidable a maximum distance between a retracted configuration and an extended configuration and disposed substantially as a diagonal for said parallelogrammatic structure wherein said telescoping support has two ends, each of which is pivotally connected to said parallelogrammatic structure, comprising:

a first cylindrical member having a longitudinal slot with a plurality of notches, said first cylindrical member having one end pivotally connected to a pivot pin connected to said parallelogrammatic structure such that said first cylindrical member is capable of angular movement about said pivot pin within the plane of said parallelogrammatic structure, and said first cylindrical member also having two elongated bores through which said pivot pin is disposed such that said first cylindrical member is capable of limited rotational movement about its longitudinal axis;

a second cylindrical member slidably connected to said first cylindrical member and having a post disposed within said slot, wherein said post slides along the length of said slot as said first cylindrical member slides with respect to said second cylindrical member and said post may engage one of said notches to restrict further movement of said first and second cylindrical members with respect to each other, and wherein said first and second cylindrical members are concentric and said first cylindrical member is disposed, at least partially, within said second cylindrical member;

a rotator means for rotating one of said cylindrical members about its longitudinal axis whereby said post is disengaged from one of said notches and is disposed for slidable movement along the length of said slot thereby allowing said telescoping support to extend and contract its length; and means for restricting the sliding movement of said first and second cylindrical members when one of the cylindrical members is rotated and released such that the inadvertent momentary actuation of said rotator means results in the cylindrical members sliding substantially less than said maximum distance.

2. An adjustable support system as set forth in claim 1 wherein said first cylindrical member is connected to a biasing means which biases said first cylindrical member against rotation and holds said first cylindrical member in a first position, such that when said first cylindrical member is in said first position said post is in engagement with one of said notches and the sliding movement of said first cylindrical member with respect to said second cylindrical member is restricted.

3. An adjustable support system as set forth in claim 2 wherein said rotator means is connected to said first cylindrical member and said rotator means, when actuated, acts against said biasing means to rotate said first cylindrical member to a second position, such that when said first cylindrical member is in said second position said post is disengaged from any of said notches and is disposed for slidable movement along the length of said slot.

4. An adjustable support system as defined in claim 3 wherein each of said notches has a bevelled side such that when a force which tends to contract said telescoping support is applied to the parallelogrammatic structure, said post will move from said first position to said second position without actuation of said rotator means.

5. An adjustable support system as set forth in claim 1 wherein said rotator means is connected to said first cylindrical member such that actuation of said rotator means causes said first cylindrical member to rotate whereby said post is disengaged from one of said notches and is disposed for slidable movement along the length of said slot.

6. An adjustable support system as defined in claim 1 wherein said notches are spaced along said slot at predetermined intervals which correspond to predetermined desired shapes for the parallelogrammatic structure.

7. An adjustable support system as set forth in claim 1 wherein said second cylindrical member is pivotally connected to the parallelogrammatic structure at a location spaced from the vertexes of the parallelogrammatic structure.

8. An adjustable support system as set forth in claim 7 wherein said first cylindrical member is pivotally connected to one of the vertexes of the parallelogrammatic structure.

9. An adjustable support system as set forth in claim 1 further comprising a counterbalance means connected to the parallelogrammatic structure such that it biases said telescoping support against extension of its length.

10. An adjustable support system as set forth in claim 1 further comprising a centering means in communication with and disposed within said first cylindrical member, said centering means positioning said first cylindrical member to permit rotation about its longitudinal axis.

11. An adjustable structure for raising and lowering the height of a basketball goal having a backboard and a basketball hoop, comprising:

a basketball backboard;

a deformable parallelogrammatic structure comprising:

a rigid vertical support, an upper support member pivotally connected to said rigid vertical support and to said backboard, a lower support member pivotally connected to said rigid vertical support and to said backboard, said lower support member being substantially parallel to, of equal length to, and spaced from said upper support member;

means for securing said deformable parallelogrammatic structure to a stationary object;

a telescoping support disposed substantially as a diagonal for said parallelogrammatic structure wherein said telescoping support has two ends, each of which is pivotally connected to said parallelogrammatic structure, said telescoping support comprising:

a first cylindrical member having a longitudinal slot with a plurality of notches; and a second cylindrical member, slidably connected to said first cylindrical member, having a post disposed within said slot, wherein said post slides along the length of said slot as said first cylindrical member slides with respect to said second cylindrical member and said post may engage one of said notches to restrict further movement of said first and second cylindrical members with respect to each other;

rotator means for rotating one of said cylindrical members about its longitudinal axis wherein said post is disengaged from one of said notches and is disposed for slidable movement along the length of said slot thereby allowing said telescoping support to extend and contract its length, said rotator means including a lever plate which is in communication with said telescoping support and which is connected to said parallelogrammatic structure at a fulcrum pivot point, said lever plate being capable of movement about said fulcrum pivot point and communicating a force applied to an end of said lever plate to said telescoping support for rotating one of said cylindrical members about its longitudinal axis, said lever plate including a release cup disposed at one end for receiving the tip of a force applying implement and for restraining the tip of the implement from inadvertent slippage from said release plate; and means for biasing said rotator means such that said post is normally engaged in one of said notches such that the inadvertent actuation of the rotator means causes said telescoping support to extend only a portion of its length.

12. An adjustable structure as set forth in claim 11 wherein said first and second cylindrical members are concentric and said first cylindrical member is disposed, at least partially, within said second cylindrical member.

13. An adjustable structure as set forth in claim 12 wherein said first cylindrical member has one end pivotally connected to a pivot pin connected to said parallelogrammatic structure such that said first cylindrical member is capable of angular movement about said pivot pin within the plane of said parallelogrammatic structure, and said first cylindrical member has two elongated bores through which said pivot pin is disposed such that said first cylindrical member is capable of limited rotational movement about its longitudinal axis.

14. An adjustable structure as set forth in claim 13 wherein said means for biasing comprises a spring device and wherein the first cylindrical member is connected to the spring device which biases said first cylindrical member against rotation and holds said first cylindrical member in a first position, such that when said first cylindrical member is in said first position said post is in engagement with one of said notches and the sliding movement of said first cylindrical member with respect to said second cylindrical member is restricted.

15. An adjustable structure as set forth in claim 14 wherein said rotator means is connected to said first cylindrical member and said rotator means, when actuated, acts against said spring device to rotate said first cylindrical member to a second position, such that when said first cylindrical member is in said second position said post is disengaged from any of said notches and is disposed for slidable movement along the length of said slot.

16. An adjustable structure as defined in claim 15 wherein each of said notches has a bevelled side such that when a force which tends to contract said telescoping support is applied to said parallelogrammatic structure, said post will move from said first position to said second position without actuation of said rotator means.

17. An adjustable structure as set forth in claim 13 further comprising a centering means in communication with said disposed within said first cylindrical member, said centering means positioning said first cylindrical member to permit rotation about its longitudinal axis.

18. An adjustable structure as set forth in claim 11 wherein said rotator means is connected to said first cylindrical member such that actuation of said rotator means causes said first cylindrical member to rotate whereby said post is disengaged from one of said notches and is disposed for slidable movement along the length of said slot.

19. An adjustable structure as defined in claim 11 wherein said notches are spaced along said slot at predetermined intervals which correspond to predetermined desired shapes for said parallelogrammatic structure and predetermined heights at which the basketball goal may be positioned.

20. An adjustable structure as set forth in claim 11 wherein said second cylindrical member is pivotally connected to said parallelogrammatic structure at a location spaced from a vertex of said parallelogrammatic structure.

21. An adjustable structure as set forth in claim 20 wherein said first cylindrical member is pivotally connected to one of the vertexes of said parallelogrammatic structure.

22. An adjustable structure as set forth in claim 20 wherein said second cylindrical member is pivotally connected to said upper support member to permit angular movement of said second cylindrical member within the plane of said parallelogrammatic structure.

23. An adjustable structure as set forth in claim 11 wherein said rigid vertical support comprises a rigid support plate affixed to a rigid pole.

24. An adjustable structure as set forth in claim 11 wherein said rigid vertical support comprises a rigid support plate.

25. An adjustable structure as defined in claim 11 wherein said slot and said post are disposed on the underneath side of said telescoping support.

26. An adjustable structure as set forth in claim 11 wherein said parallelogrammatic structure further comprises a mounting plate rigidly connected to the backboard, said mounting plate being pivotally connected to said upper and said lower support members.

27. An adjustable structure as set forth in claim 26 wherein said mounting plate extends below the backboard thereby serving as a shield against inadvertent actuation of said rotator means.

28. An adjustable structure as set forth in claim 11 further comprising a counterbalance means connected to said parallelogrammatic structure such that it biases said telescoping support against extension of its length.

29. An adjustable structure as set forth in claim 28 wherein said counterbalance means is disposed within said telescoping support.

30. An adjustable structure as set forth in claim 11 wherein said means for biasing comprises a spring device connected to said telescoping support which biases the one of said cylindrical members rotatable by said rotator means against rotation.

31. An adjustable structure as set forth in claim 30 wherein said spring device comprises a coiled spring.

32. An adjustable structure as set forth in claim 31 further comprising means for anchoring said spring at one of a plurality of locations remote from said telescoping support such that the tension of said spring may be adjusted by adjusting the length of said spring.

33. An adjustable structure as set forth in claim 11 further comprising a guide loop connected to the basketball goal remote from said rigid vertical support, said guide loop being configured to receive the tip of a rod used to apply a force to said parallelogrammatic structure, said guide loop prevents the tip of the rod from slipping when the force is applied.

34. An adjustable support system as set forth in claim 11 wherein said lever plate is connected to a biasing means which holds said lever plate in an undepressed position and biases said lever plate against movement about its fulcrum pivot point unless a predetermined amount of force is applied at the release cup end of said lever plate.

35. An adjustable support system as set forth in claim 34 wherein said telescoping support has a rocker arm rigidly secured to said telescoping support and in communication with said lever plate, said rocker arm being disposed on said telescoping support such that when a sufficient force is applied to said lever plate at the release cup end said lever plate moves about the fulcrum pivot point to a depressed position and such movement is communicated to said rocker arm thereby causing one of said cylindrical members to rotate about its longitudinal axis.

36. A method for raising the height of a basketball goal from a first, lower predetermined height to a second, higher predetermined height by altering the shape of a deformable parallelogrammatic structure, the parallelogrammatic structure having vertically disposed opposite sides, one side connected to the basketball goal and the opposite side being a rigid vertical support, a guide loop connected to the basketball goal, and a telescoping support with two ends, each of which is pivotally connected to the parallelogrammatic structure, a first cylindrical member having a slot with a plurality of notches wherein each notch has a bevelled side, and a second cylindricl member slidably connected to the first cylindrical member and having a post disposed within the slot wherein the post may slide along the length of the slot as the first cylindrical member slides with respect to the second cylindrical member and wherein the post may engage one of the notches to restrict further movement of the first and second cylindrical member with respect to each other, one of the cylindrical members being rotatable about is longitudinal axis, comprising the steps of:

engaging the guide loop with the tip of an implement used for applying a force at a desired point;

applying force to the basketball goal at the guide loop thereby resulting in a force being applied to the parallelogrammatic structure such that the resultant force on the parallelogrammatic structure tends to contract the length of the telescoping support thereby pressing the bevelled side of one of the notches against the post and causing the rotatable cylindrical member to rotate from a first position wherein the post is positioned within one of the notches to a second position whereby the post is disengaged from the notches and is disposed for slidable movement along the length of the slot thereby permitting the telescoping support to extend and contract its length;

raising the basketball goal to the second predetermined height by continuing to apply a force to the parallelogrammatic structure such that the post slidably travels the slot to a position wherein the post aligns with a notch corresponding to the second predetermined height;

rotating the rotatable cylindrical member so that the post engages the notch corresponding to the second predetermined height; and releasing the force being applied to the parallelogrammatic structure.

37. A method for raising the height of a basketball goal as set forth in claim 36 wherein the rotatable cylindrical member is biased against rotation and the step of rotating the rotatable cylindrical member to return the post to engagement with a notch is caused by such biasing.

38. A method for lowering the height of a basketball goal connected to a deformable parallelogrammatic structure from one predetermined height to a second lower predetermined height wherein a guide loop is connected to the basketball goal, the parallelogrammatic structure having a rigid vertical side and a substantially diagonally disposed telescoping support with two ends, each of which is pivotally connected to the parallelogrammatic structure, a first cylindrical member having a slot with a plurality of notches wherein each notch has a bevelled side, and a second cylindrical member slidably connected to the first cylindrical member and having a post disposed within the slot wherein the post may slide along the length of the slot as the first cylindrical member slides with respect to the second cylindrical member and wherein the post may engage one of the notches to restrict further movement of the first and second cylindrical members with respect to each other, one of the cylindrical members being rotatable about its longitudinal axis, comprising the steps of:

rotating the rotatable cylindrical member about its longitudinal axis from a first position wherein the post is positioned within one of the notches to a second position whereby the post is disengaged from the notches and is disposed for slidable movement along the length of the slot thereby permitting the telescoping support to extend its length;

extending the length of the telescoping support by lowering the basketball goal to its lowest position thereby causing the post to slide along the slot to its full length to align with and engage the notch corresponding to the lowest predetermined height for the basketball goal;

engaging the guide loop with the tip of an implement used for applying a force at a desired point and applying force to the basketball goal at the guide loop thereby resulting in a force being applied to the parallelogrammatic structure such that the resultant force on the parallelogrammatic structure tends to contract the length of the telescoping support thereby pressing the bevelled side of the notch against the post and causing the rotatable cylindrical member to rotate from the first position wherein the post is positioned within one of the notches to a second position whereby the post is disengaged from the notches and is disposed for slidable movement along the length of the slot thereby permitting the telescoping support to contract its length;

moving the basketball goal to the second predetermined height by continuing to apply a force to the parallelogrammatic structure such that the post slidably travels the slot to a position wherein the post aligns with a notch corresponding to the second predetermined height;

rotating the rotatable cylindrical member so that the post engages the notch corresponding to the second predetermined height; and releasing the force being applied to the parallelogrammatic structure.

39. A method for lowering the height of a basketball goal as set forth in claim 38 wherein the parallelogrammatic structure has a rotator means and the step of rotating one of the cylindrical members about its longitudinal axis from said first position to said second position comprises the step of actuating the rotator means connected to the cylindrical member which is being rotated.

40. A method for lowering the height of a basketball goal as set forth in claim 39 wherein the rotator means comprises a lever plate in communication with the telescoping support and connected to the parallelogrammatic structure at a fulcrum pivot point and the step of actuating the rotator means comprises the steps of:

engaging the end of the lever plate distant from communication with the telescoping support with the tip of an implement used for applying a force at a desired point; and depressing the end of the lever plate from an undepressed position to a depressed position by applying a force via the implement to the lever plate, thereby transferring the force about the fulcrum pivot point through the lever plate to the telescoping support and causing the cylindrical member which is being rotated to rotate.

41. A method for lowering the height of a basketball goal as set forth in claim 38 wherein the cylindrical member which is rotated about its longitudinal axis from said first position to said second position is the first cylindrical member.

42. A method for lowering the height of a basketball goaal as set forth in claim 38 wherein the rotatable cylindrical member is biased against rotation and the step of rotating the rotatable cylindrical member to return the post to engagement with a notch is caused by such biasing.

43. An adjustable basketball goal system allowing for adjustment of the height of the basketball goal above a playing surface, comprising:

a deformable parallelogrammatic structure;

means for securing said deformable parallelogrammatic structure to a rigid object such that the parallelogrammatic structure is suspended above the playing surface;

means for attaching the basketball goal to said parallelogrammatic structure; and a telescoping support, said telescoping support being slidable a maximum distance between a retracted configuration and an extended configuration and disposed substantially as a diagonal for the parallelogrammatic structure, said telescoping support comprising:

a first cylindrical member pivotally connected to the parallelogrammatic structure, said first cylindrical member having one end pivotally connected to a pivot pin connected to said parallelogrammatic structure such that said first cylindrical member is capable of angular movement about said pivot pin within the plane of said parallelogrammatic structure, said first cylindrical member also having two elongated bores through which said pivot pin is disposed such that said first cylindrical member is capable of limited rotational movement about its longitudinal axis;

a second cylindrical member slidably connected to said first cylindrical member and pivotally connected to said parallelogrammatic structure, said first and second cylindrical members being configured such that they are concentric and said first cylindrical member is disposed, at least partially, within said second cylindrical member, said first cylindrical member having a longitudinal slot with a plurality of notches and said second cylindrical member having a post disposed within said slot, wherein said post slides along the length of said slot as said first cylindrical member slides with respect to said second cylindrical member and said post may engage one of said notches to restrict further movement of said first and second cylindrical members with respect to each other;

locking means for restricting the sliding movement of said second cylindrical member relative to said first cylindrical member, in at least a first direction, said locking means having both an engaged and a disengaged position, said locking means being disengaged by the rotation of one cylindrical member relative to the other cylindrical member; and means for urging said locking means into the engaged position such that inadvertent rotation of one of said cylindrical members results in the cylindrical members sliding less than said maximum distance and such that a user may disengage the locking means and adjust the height of the basketball goal.

44. An adjustable support system as described in claim 43 further comprising a rotator means for rotating one of said cylindrical members about its longitudinal axis whereby said locking means may be actuated.

45. An adjustable basketball goal system as set forth in claim 43 wherein said means for urging comprises a biasing means and wherein said first cylindrical member is connected to said biasing means which biases said first cylindrical member against rotation and holds said first cylindrical member in a first position, such that when said first cylindrical member is in said first position said post is in engagement with one of said notches and the sliding movement of said first cylindrical member with respect to said second cylindrical member is restricted.

46. An adjustable basketball goal system as set forth in claim 43 further comprising a counterbalance means connected to said parallelogrammatic structure such that it biases said telescoping support against extension of its length.

47. An adjustable basketball goal system as set forth in claim 43 wherein the means for urging comprises a spring device connected to said telescoping support which biases the one of said cylindrical members against rotation.

48. An adjustable basketball goal system as set forth in claim 47 wherein said spring device comprises a coiled spring.

49. An adjustable basketball goal apparatus which may be adjusted to a plurality of heights above a playing surface comprising:

a basketball goal comprising a basketball backboard and a basketball rim;

a deformable parallelogrammatic structure;

means for securing said basketball goal to said deformable parallelogrammatic structure;

means for securing said deformable parallelogrammatic structure to a rigid object such that said basketball goal is suspended above the playing surface;

a first cylindrical member pivotally connected to said parallelogrammatic structure, said first cylindrical member having one end pivotally connected to a pivot pin connected to said parallelogrammatic structure such that said first cylindrical member is capable of angular movement about said pivot pin within the plane of said parallelogrammatic structure, said first cylindrical member also having two elongated bores through which said pivot pin is disposed such that said first cylindrical member is capable of limited rotational movement about its longitudinal axis;

a second cylindrical member slidably connected to said first cylindrical member and pivotally connected to said parallelogrammatic structure, said first and second cylindrical members together comprising a telescoping support, said telescoping support being slidable a maximum distance between a retracted configuration and an extended configuration;

restricting means for restricting the sliding movement of said second cylindrical member, relative to said first cylindrical member, in at least a first direction, said restricting means having an engaged and a disengaged position, said first and second cylindrical members being configured such that they are concentric and said first cylindrical member is disposed, at least partially, within said second cylindrical member, said restricting means including a longitudinal slot and a plurality of notches formed on said first cylindrical member and a post formed on said second cylindrical member disposed within said slot, wherein said post slides along the length of said slot as said first cylindrical member slides with respect to said second cylindrical member and said post may engage one of said notches of restrict further movement of said first and second cylindrical members with respect to each other;

rotator means for rotating one of said cylindrical members relative to the other to engage and disengage said restricting means; and means for biasing the rotator means so as to urge the restricting means into said engaged position such that the inadvertent rotation of one of said cylindrical members results in said telescoping support sliding less than said maximum distance and such that a user may disengage said restricting means and adjust the height of the basketball goal.

50. An adjustable support system as set forth in claim 49 wherein said first cylindrical member is connected to a biasing means which biases said first cylindrical member against rotation and holds said first cylindrical member in a first position, such that when said first cylindrical member is in said first position said post is in engagement with one of said notches and the sliding movement of said first cylindrical member with respect to said second cylindrical member is restricted.

51. An adjustable support system as set forth in claim 49 further comprising a counterbalance means connected to said parallelogrammatic structure such that said counterbalance means biases said telescoping support against the extension of its length.

52. An adjustable support system as set forth in claim 49 wherein said means for biasing the rotator means comprises a biasing means connected to said telescoping support which biases one of said cylindrical members against rotation.

53. An adjustable support system as set forth in claim 51 wherein said biasing means comprises a spring.

54. An adjustable basketball goal system for adjustment of the height of a basketball goal above a playing surface, comprising:

a deformable parallelogrammatic structure;

means for securing the basketball goal to said parallelogrammatic structure;

means for securing said parallelogrammatic structure to a rigid vertical support such that said parallelogrammatic structure is suspended above the playing surface;

a telescoping support, said telescoping support being slidable a maximum distance between a retracted configuration and an extended configuration and disposed substantially as a diagonal for said parallelogrammatic structure wherein said telescoping support has two ends, each of which is pivotally connected to said parallelogrammatic structure, said telescoping support comprising:

a first cylindrical member having a longitudinal slot with a plurality of notches;

a second cylindrical member slidably connected to said first cylindrical member and having a post disposed within said slot, wherein said post slides along the length of said slot as said first cylindrical member slides with respect to said second cylindrical member and said post may engage one of said notches to restrict further movement of said first and second cylindrical members with respect to each other;

rotator means for rotating one of said cylindrical members about its longitudinal axis whereby said post is disengaged from one of said notches and is disposed for slidable movement along the length of said slot thereby allowing said telescoping support to extend and contract its length; and means for restricting the sliding movement of said first and second cylindrical members when one of the cylindrical members is rotated and released such that the inadvertent momentary actuation of said rotator means results in the cylindrical members sliding substantially less than said maximum distance;

a spring connected to said telescoping support which biases the one of said cylindrical members rotatable by said rotator means against rotation; and means for anchoring said spring at one of a plurality of locations remote from said telescoping support such that the tension of said spring may be adjusted by adjusting the length of said spring.

55. An adjustable support system as set forth in claim 54 wherein said rotator means is connected to said first cylindrical member such that actuation of said rotator means causes said first cylindrical member to rotate whereby said post is disengaged from one of said notches and is disposed for slidable movement along the length of said slot.

56. An adjustable support system as set forth in claim 54 further comprising a counterbalance means connected to the parallelogrammatic structure such that it biases said telescoping support against extension of its length.

57. An adjustable basketball goal system for adjustment of the height of a basketball goal above a playing surface, comprising:

a deformable parallelogrammatic structure;

means for securing the basketball goal to said parallelogrammatic structure;

means for securing said parallelogrammatic structure to a rigid vertical support such that said parallelogrammatic structure is suspended above the playing surface; and a telescoping support, said telescoping support being slidable a maximum distance between a retracted configuration and an extended configuration and disposed substantially as a diagonal for said parallelogrammatic structure wherein said telescoping support has two ends, each of which is pivotally connected to said parallelogrammatic structure, comprising:

a first cylindrical member having a longitudinal slot with a plurality of notches;

a second cylindrical member slidably connected to said first cylindrical member and having a post disposed within said slot, wherein said post slides along the length of said slot as said first cylindrical member slides with respect to said second cylindrical member and said post may engage one of said notches to restrict further movement of said first and second cylindrical members with respect to each other;

rotator means for rotating one of said cylindrical members about its longitudinal axis whereby said post is disengaged from one of said notches and is disposed for slidable movement along the length of said slot thereby allowing said telescoping support to extend and contract its length, said rotator means including a lever plate which is in communication with said telescoping support and which is connected to the parallelogrammatic structure at a fulcrum pivot point, said lever plate being capable of movement about said fulcrum pivot point and communicating a force applied to an end of said lever plate to said telescoping support for rotating one of said cylindrical members about its longitudinal axis, said lever plate including a release cup disposed at one end for receiving the tip of a force applying implement and for restraining the tip of the implement from inadvertent slippage from said release plate; and means for restricting the sliding movement of said first and second cylindrical members when one of the cylindrical members is rotated and released such that the inadvertent momentary actuation of said rotator means results in the cylindrical members sliding substantially less than said maximum distance.

58. An adjustable support system as set forth in claim 57 wherein said lever plate is connected to a biasing means which holds said lever plate in an undepressed position and biases said lever plate against movement about its fulcrum pivot point unless a predetermined amount of force is applied at the release cup end of said lever plate.

59. An adjustable support system as set forth in claim 58 wherein said telescoping support has a rocker arm rigidly secured to said telescoping support and in communication with said lever plate, said rocker arm being disposed on said telescoping support such that when a sufficient force is applied to said lever plate at the release cup end said lever plate moves about the fulcrum pivot point to a depressed position and such movement is communicated to said rocker arm thereby causing one of said cylindrical members to rotate about its longitudinal axis.

60. An adjustable support system as set forth in claim 57 wherein said rotator means is connected to said first cylindrical member such that actuation of said rotator means causes said first cylindrical member to rotate whereby said post is disengaged from one of said notches and is disposed for slidable movement along the length of said slot.

61. An adjustable support system as defined in claim 57 wherein said notches are spaced along said slot at predetermined intervals which correspond to predetermined desired shapes for the parallelogrammatic structure.

62. An adjustable support system as set forth in claim 57 further comprising a counterbalance means connected to the parallelogrammatic structure such that it biases said telescoping support against extension of its length.

63. An adjustable support system as set forth in claim 9 wherein said counterbalance means is disposed within said telescoping support.

* * * * *

UNITED STATES PATENT AND TRADEMARK OFFICE

CERTIFICATE OF CORRECTION

PATENT NO. : 4,781,375

DATED : November 1, 1988

INVENTOR(S) : Stephen F. Nye

It is certified that error appears in the above—identified patent and that said Letters Patent is hereby corrected as shown below:

Column 6, line 34, "up to down" should be --up or down--
Column 8, lines 24-25, "basbetball" should be --basketball--
Column 12, line 47, "balancing" should be --biasing--
Column 13, line 2, "notch 26." should be --notch 36.--
Column 15, line 44, "," should be --;--
Column 15, line 46, "," should be --; and--
Column 16, line 8, "rotator" should be --rotation--
Column 17, line 3, "with said" should be --with and--
Column 18, line 40, "cylindricl" should be --cylindrical--
Column 22, line 44, "of restrict" should be --to restrict--

Signed and Sealed this

Twenty-eighth Day of November 1989

*Attest:*

JEFFREY M. SAMUELS

*Attesting Officer* *Acting Commissioner of Patents and Trademarks*